US007103982B2

(12) United States Patent
Haugland

(10) Patent No.: US 7,103,982 B2
(45) Date of Patent: Sep. 12, 2006

(54) DETERMINATION OF BOREHOLE AZIMUTH AND THE AZIMUTHAL DEPENDENCE OF BOREHOLE PARAMETERS

(75) Inventor: Samuel Mark Haugland, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 86 days.

(21) Appl. No.: 10/984,082

(22) Filed: Nov. 9, 2004

(65) Prior Publication Data

US 2006/0096105 A1 May 11, 2006

(51) Int. Cl.
*E21B 47/022* (2006.01)

(52) U.S. Cl. ..... 33/304; 33/313; 702/6; 73/152.01; 73/152.04; 75/40

(58) Field of Classification Search ..... 33/301–304, 33/542, 544, 313, 1 H; 73/152.01, 152.54; 175/40

See application file for complete search history.

(56) References Cited

U.S. PATENT DOCUMENTS 5,023,450 A 6/1991 Gold
5,045,795 A 9/1991 Gianzero et al.
5,184,079 A 2/1993 Barber
5,339,036 A 8/1994 Clark et al.
5,357,797 A 10/1994 Maki, Jr. et al.
5,422,480 A 6/1995 Schultz
5,461,562 A 10/1995 Tabanou et al.
5,469,736 A 11/1995 Moake
5,473,158 A 12/1995 Holenka et al.
5,486,695 A 1/1996 Schultz et al.
5,513,528 A 5/1996 Holenka et al.
5,591,967 A 1/1997 Moake
5,638,337 A 6/1997 Priest
5,675,488 A 10/1997 McElhinney
5,737,277 A 4/1998 Priest
5,899,958 A 5/1999 Dowell et al.

(Continued)

FOREIGN PATENT DOCUMENTS

EP 0793000 4/2001

(Continued)

OTHER PUBLICATIONS

Birchak, J.R., Matthews, R. G., Moake, G.L. and Schultz, W. E., "Standoff and Caliper Measurements While Drilling Using a New Formation-Evaluation Tool with Three Ultrasonic Transducers", 68th Annual Technical Conference and Exhibition of the Society of Petroleum Engineers held in Houston Texas, Oct. 3-6, 1993, SPE 26494, pp. 793-806.

(Continued)

*Primary Examiner*—Yaritza Guadalupe-McCall

(57) ABSTRACT

A method for determining a borehole azimuth in a borehole is disclosed. In one exemplary embodiment, the method includes acquiring at least one standoff measurement and a tool azimuth measurement at substantially the same time. Such measurements are then processed, along with a lateral displacement vector of the downhole tool upon which the sensors are deployed in the borehole, to determine the borehole azimuth. The computed borehole azimuths may be advantageously correlated with logging sensor data to form a borehole image, for example, by convolving the correlated logging sensor data with a window function. As such, exemplary embodiments of this invention may provide for superior image resolution and noise rejection as compared to prior art LWD imaging techniques.

28 Claims, 5 Drawing Sheets

U.S. PATENT DOCUMENTS

| | | | | |
|---|---|---|---|---|
| 5,966,013 | A | 10/1999 | Hagiwara | |
| 6,038,513 | A | 3/2000 | Varsamis et al. | |
| 6,065,219 | A | 5/2000 | Murphey et al. | |
| 6,131,694 | A | 10/2000 | Robbins et al. | |
| 6,307,199 | B1 | 10/2001 | Edwards et al. | |
| 6,321,456 | B1 | 11/2001 | McElhinney | |
| 6,326,784 | B1 | 12/2001 | Ganesan et al. | |
| 6,584,837 | B1 | 7/2003 | Kurkoski | |
| 6,619,395 | B1 | 9/2003 | Spross | |
| 6,845,563 | B1 * | 1/2005 | Lewis et al. | 33/313 |
| 6,871,410 | B1 * | 3/2005 | Le Jeune | 33/313 |
| 7,028,409 | B1 * | 4/2006 | Engebretson et al. | 33/304 |

FOREIGN PATENT DOCUMENTS

| | | | |
|---|---|---|---|
| GB | 2400435 | A | 4/2002 |

OTHER PUBLICATIONS

Oppenheim, A. V. and Schafer, R.W., Digital Signal Processing, Prentice-Hall, 1975, pp. 239-250 and pp. 548-554.

Jan, Yih-Min and Harrell, John W., "MWD Directional-Focused Gamma Ray—A New Tool For Formation Evaluation And Drilling Control In Horizontal Wells", SPWLA Twenty-Eighth Annual Logging Symposium, Jun. 29-Jul. 2, 1987, Paper A.

* cited by examiner

DETERMINATION OF BOREHOLE AZIMUTH AND THE AZIMUTHAL DEPENDENCE OF BOREHOLE PARAMETERS

FIELD OF THE INVENTION

The present invention relates generally to a method for logging a subterranean borehole. More specifically, this invention relates to processing a standoff measurement and a tool azimuth measurement to determine a borehole azimuth and correlating the borehole azimuth with logging while drilling sensor measurements to estimate the azimuthal dependence of a borehole parameter.

BACKGROUND OF THE INVENTION

Wireline and logging while drilling (LWD) tools are often used to measure physical properties of the formations through which a borehole traverses. Such logging techniques include, for example, natural gamma ray, spectral density, neutron density, inductive and galvanic resistivity, acoustic velocity, acoustic calliper, downhole pressure, and the like. Formations having recoverable hydrocarbons typically include certain well-known physical properties, for example, resistivity, porosity (density), and acoustic velocity values in a certain range. In many applications (particularly LWD applications) it is desirable to make azimuthally sensitive measurements of the formation properties and in particular, images derived from such azimuthally sensitive measurements, which may be utilized, for example, to locate faults and dips that may occur in the various layers that make up the strata.

Prior art borehole imaging techniques utilize a measured tool azimuth to register azimuthally sensitive sensor data and assume that the measured tool azimuth is substantially identical to the true borehole azimuth. Such techniques are generally suitable for wireline applications in which the logging tool is typically centered in the borehole and thus in which the tool and borehole azimuths are typically substantially identical. However, in LWD applications, an LWD tool is not typically centered in the borehole (i.e., the longitudinal axes of the tool and the borehole are not coincident) since the tool is coupled to a drill string. It is well known that a drill string is often substantially free to translate laterally in the borehole (e.g., during drilling) such that the eccentricity of an LWD tool in the borehole may change with time. Therefore, the assumption that tool and borehole azimuths are substantially identical is not typically valid for LWD applications. Rather, such an assumption often leads to misregistration of LWD sensor data and may therefore result image distortion.

It will therefore be appreciated that there exists a need for improved LWD borehole imaging techniques. In particular, a need exists for a method of determining borehole azimuths. Such borehole azimuths may then be utilized, for example, to register azimuthally sensitive LWD sensor data and thereby form improved borehole images.

SUMMARY OF THE INVENTION

The present invention addresses one or more of the above-described drawbacks of prior art techniques for borehole imaging. Aspects of this invention include a method for determining a borehole azimuth. The method typically includes acquiring at least one standoff measurement and a corresponding tool azimuth measurement. Such measurements may then be processed, along with a lateral displacement vector of the downhole tool upon which the sensors are deployed, in the borehole to determine the borehole azimuth. Alternatively, such measurements may be substituted into a system of equations that may be solved for the lateral displacement vector and the borehole azimuth(s) at each of the standoff sensor(s) on a downhole tool. In another exemplary embodiment of this invention, such borehole azimuths may be correlated with logging sensor data to form a borehole image, for example, by convolving the correlated logging sensor data with a window function.

Exemplary embodiments of the present invention may advantageously provide several technical advantages. For example, embodiments of this invention enable borehole azimuths to be determined for a borehole having substantially any shape. Furthermore, in certain exemplary embodiments, borehole azimuths, lateral displacement vector(s), and a borehole parameter vector defining the shape and orientation of the borehole may be determined simultaneously. Moreover, in certain exemplary embodiments, such parameters may be determined via conventional ultrasonic standoff measurements and conventional tool azimuth measurements.

Exemplary methods according to this invention also provide for superior image resolution and noise rejection as compared to prior art LWD imaging techniques. In particular, exemplary embodiments of this invention tend to minimize misregistration errors caused by tool eccentricity. Furthermore, exemplary embodiments of this invention enable aliasing effects to be decoupled from statistical measurement noise, which tends to improve the usefulness of the borehole images in determining the actual azimuthal dependence of the formation parameter of interest.

In one aspect the present invention includes a method for determining a borehole azimuth in a borehole. The method includes providing a downhole tool in the borehole, the tool including at least one standoff sensor and an azimuth sensor deployed thereon. The method further includes causing the at least one standoff sensor and the azimuth sensor to acquire at least one standoff measurement and a tool azimuth measurement at substantially the same time and processing the standoff measurement, the tool azimuth measurement, and a lateral displacement vector between borehole and tool coordinates systems to determine the borehole azimuth.

In another aspect, this invention includes a method for estimating an azimuthal dependence of a parameter of a borehole using logging sensor measurements acquired as a function of a borehole azimuth of said logging sensors. The method includes rotating a downhole tool in a borehole, the tool including at least one logging sensor, at least one standoff sensor, and an azimuth sensor, data from the logging sensor being operable to assist determination of a parameter of the borehole. The method further includes causing the at least one logging sensor to acquire a plurality of logging sensor measurements at a corresponding plurality of times and causing the at least one standoff sensor and the azimuth sensor to acquire a corresponding plurality of standoff measurements and tool azimuth measurements at the plurality of times. The method still further includes processing the standoff measurements and the azimuth measurements to determine borehole azimuth at selected ones of the plurality of times and processing a convolution of the logging sensor measurements and the corresponding borehole azimuths at selected ones of the plurality of times with a window function to determine convolved logging sensor data for at least one azimuthal position about the borehole.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
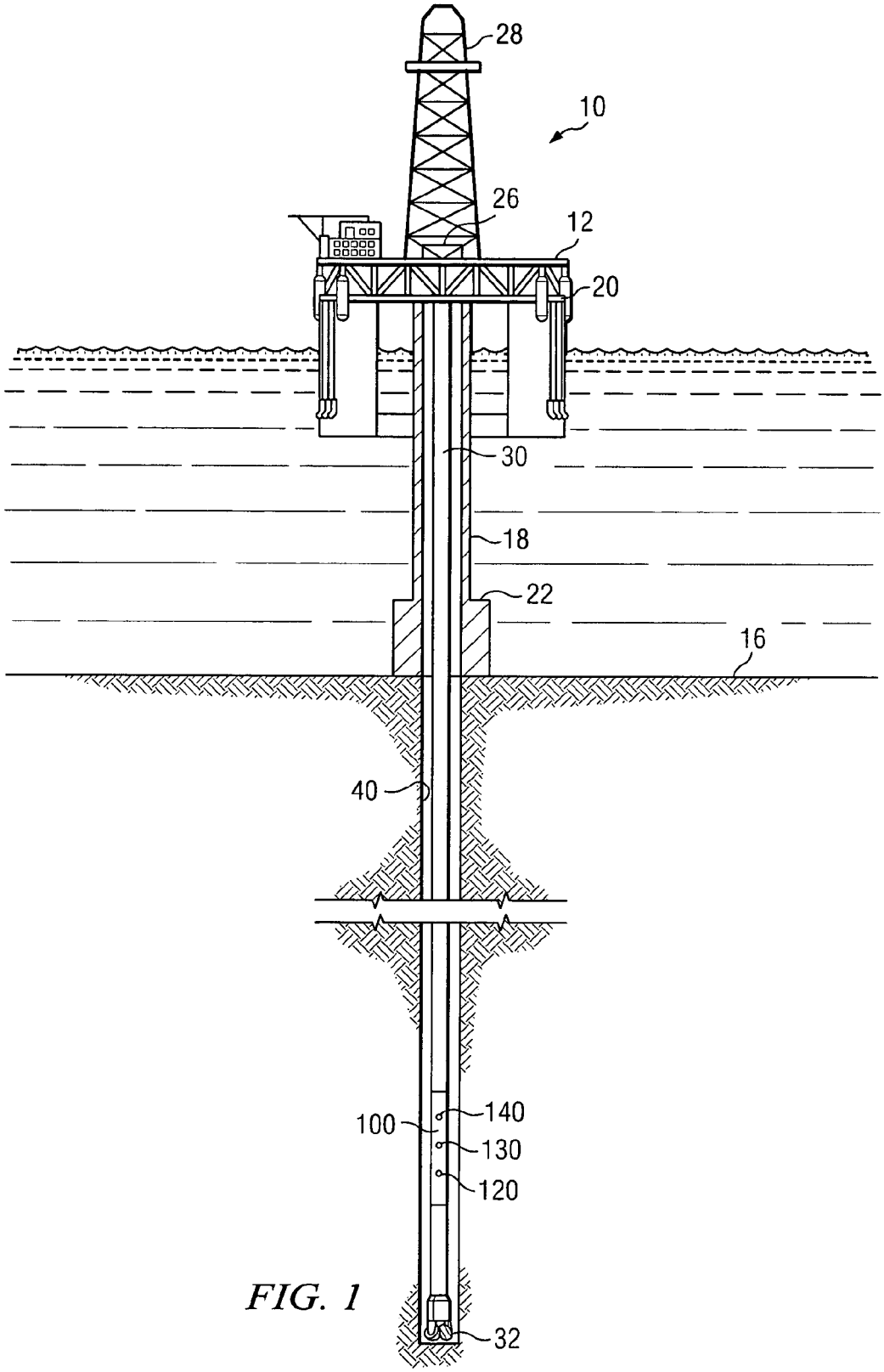
FIG. 1 is a schematic representation of an offshore oil and/or gas drilling platform utilizing an exemplary embodiment of the present invention.
Figure 2:
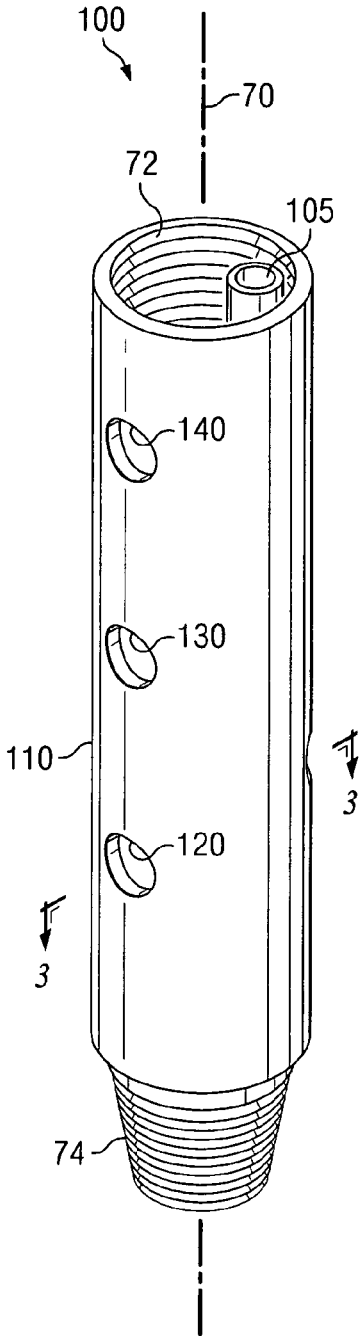
FIG. 2 depicts one exemplary measurement tool suitable for use with exemplary methods of this invention.
Figure 3:
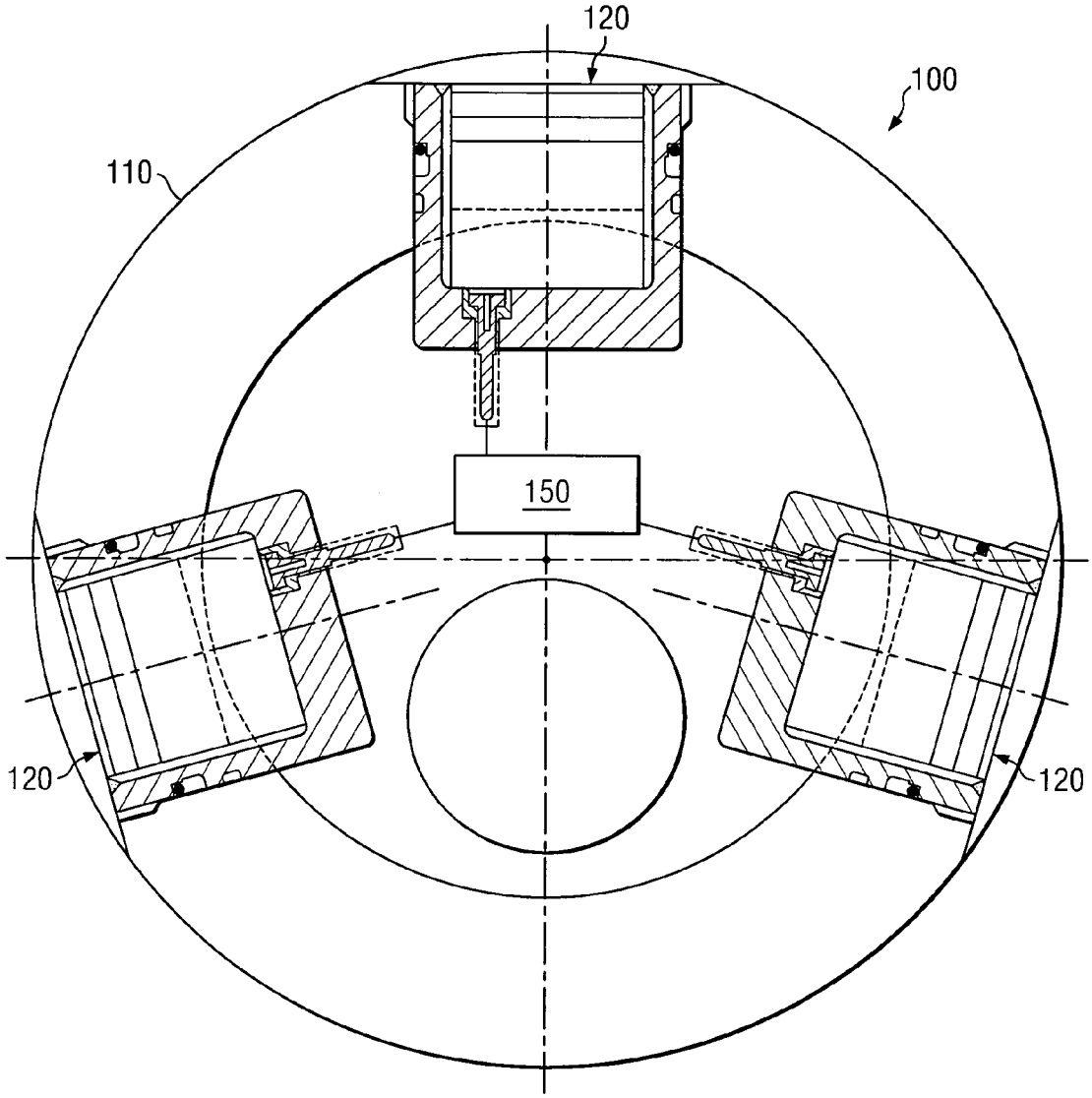
FIG. 3 is a cross sectional view as shown on FIG. 2.

With reference to FIGS. 1 through 3, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 3 may be described herein with respect to that reference numeral shown on other views.

FIG. 1 schematically illustrates one exemplary embodiment of a downhole tool 100 in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a downhole tool 100. Advantageous embodiments of downhole tool 100 typically (but not necessarily) include a plurality of standoff sensors 120 (one of which is shown in FIG. 1), at least one LWD sensor 130, and at least one azimuth sensor 140 deployed thereon.

Standoff sensor 120 may include substantially any sensor suitable for measuring the standoff distance between the sensor and the borehole wall, such as, for example, an ultrasonic sensor. LWD sensor 130 may include substantially any downhole logging sensor, for example, including a natural gamma ray sensor, a neutron sensor, a density sensor, a resistivity sensor, a formation pressure sensor, an annular pressure sensor, an ultrasonic sensor, an audio-frequency acoustic sensor, and the like. Azimuth sensor 140 may include substantially any sensor that is sensitive to its azimuth on the tool (e.g., relative to high side), such as one or more accelerometers and/or magnetometers. Drill string 30 may further include a downhole drill motor, a mud pulse telemetry system, and one or more other sensors, such as a nuclear logging instrument, for sensing downhole characteristics of the borehole and the surrounding formation.

It will be understood by those of ordinary skill in the art that the deployment illustrated on FIG. 1 is merely exemplary for purposes of describing the invention set forth herein. It will be further understood that the downhole tool 100 of the present invention is not limited to use with a semisubmersible platform 12 as illustrated on FIG. 1. Downhole tool 100 is equally well suited for use with any kind of subterranean drilling operation, either offshore or onshore. It will also be understood that this invention is not limited to the deployment of sensors 120, 130, and 140 on a single tool (as shown in FIG. 1), but rather sensors 120, 130, and 140 may be deployed, for example, on multiple downhole tools coupled with a drill string. Such tools may be communicably coupled with a central processor deployed in one of the tools or elsewhere in the drill string.

Referring now to FIG. 2, one exemplary embodiment of a downhole tool 100 from FIG. 1 is illustrated in perspective view. Downhole tool 100 is typically a substantially cylindrical tool, being largely symmetrical about longitudinal axis 70. In the exemplary embodiment shown, standoff sensors 120, LWD sensor 130, and azimuth sensor 140 are deployed in a substantially cylindrical tool collar 110. The tool collar may be configured for coupling to a drill string (e.g., drill string 30 on FIG. 1) and therefore typically, but not necessarily, includes threaded pin 74 and box 72 ends for coupling to the drill string. Through pipe 105 provides a conduit for the flow of drilling fluid downhole, for example, to a drill bit assembly (e.g., drill bit 32 on FIG. 1).

Turning now to FIG. 3, the illustrated exemplary embodiment of downhole tool 100 includes three standoff sensors 120 deployed about the circumference of the drill collar 110. It will be appreciated that this invention is not limited to any particular number or circumferential position of the standoff sensors 120. Suitable standoff sensors 120 include, for example, conventional ultrasonic sensors. Such ultrasonic sensors may operate, for example, in a pulse-echo mode in which the sensor is utilized to both send and receive a pressure pulse in the drilling fluid (also referred to herein as drilling mud). In use, an electrical drive voltage (e.g., a square wave pulse) may be applied to the transducer, which vibrates the surface thereof and launches a pressure pulse into the drilling fluid. A portion of the ultrasonic energy is typically reflected at the drilling fluid/borehole wall interface back to the transducer, which induces an electrical response therein. Various characteristics of the borehole, such as the standoff distance between the sensor and the borehole wall may be determined utilizing such ultrasonic measurements.

With continued reference to FIG. 3, the standoff sensors 120 (as well as the LWD 130 and azimuth 140 sensors) are typically coupled to a controller, which is illustrated schematically at 150. Controller 150 includes, for example, conventional electrical drive voltage electronics (e.g., a high voltage, high frequency power supply) for applying a waveform (e.g., a square wave voltage pulse) to a transducer, causing the transducer to vibrate and thus launch a pressure pulse into the drilling fluid. Controller 150 may also include receiving electronics, such as a variable gain amplifier for amplifying the relatively weak return signal (as compared to the transmitted signal). The receiving electronics may also include various filters (e.g., low and/or high pass filters), rectifiers, multiplexers, and other circuit components for processing the return signal.

A suitable controller 150 might further include a programmable processor (not shown), such as a microprocessor or a microcontroller, and may also include processor-readable or computer-readable program code embodying logic, including instructions for controlling the function of the standoff 120, LWD 130, and azimuth 140 sensors. A suitable processor may be further utilized, for example, to determine borehole azimuths, borehole shape parameters, and lateral displacements of the tool in the borehole (as described in more detail below) based on standoff and/or azimuth sensor measurements. Moreover, a suitable processor may be utilized to construct images (as described in more detail below) of the subterranean formation based on azimuthally sensitive sensor measurements and corresponding azimuth and depth information. Such information may be useful in estimating physical properties (e.g., resistivity, dielectric constant, acoustic velocity, density, etc.) of the surrounding formation and/or the materials comprising the strata.

With continued reference to FIG. 3, a suitable controller 150 may also optionally include other controllable components, such as sensors, data storage devices, power supplies, timers, and the like. The controller 150 may also be disposed to be in electronic communication with various sensors and/or probes for monitoring physical parameters of the borehole, such as a gamma ray sensor, a depth detection sensor, or an accelerometer, gyro or magnetometer to detect azimuth and inclination. Controller 150 may also optionally communicate with other instruments in the drill string, such as telemetry systems that communicate with the surface. Controller 150 may further optionally include volatile or non-volatile memory or a data storage device. The artisan of ordinary skill will readily recognize that while controller 150 is shown disposed in collar 110, it may alternatively be disposed elsewhere, either within the downhole tool 100 or at another suitable location.

In the embodiments shown in FIGS. 1 through 3, LWD 130 and azimuth 140 sensors are longitudinally spaced and deployed at substantially the same azimuthal (circumferential) position on the tool 100 as one of the standoff sensors 120. It will be appreciated that this invention is not limited to any particular layout (positioning) of the standoff 120, LWD 130, and azimuth 140 sensors on the tool 100. For example, in an alternative embodiment (not shown) the LWD 130 and azimuth 140 sensors may be deployed at substantially the same longitudinal position. It will also be appreciated that this invention is not limited to any particular number of standoff 120, LWD 130, and/or azimuth 140 sensors. Moreover, as described in more detail below, certain exemplary methods of this invention do not rely on azimuth measurements and hence do not require a downhole tool having an azimuth sensor. Certain other exemplary embodiments do not rely on standoff measurements and thus do not require the use of a standoff sensor.

Figure 4:
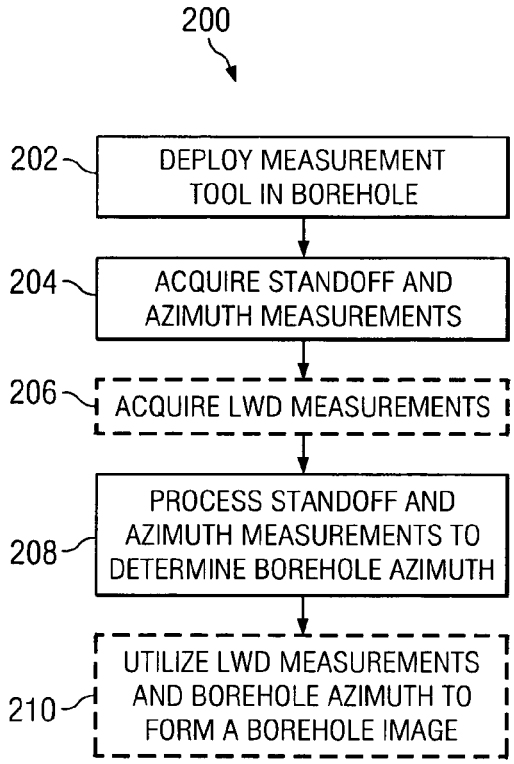
FIG. 4 depicts a flowchart of one exemplary method embodiment of this invention.

Referring now to FIG. 4, a flowchart of one exemplary embodiment of a method 200 according to this invention is illustrated. A downhole tool is deployed in a borehole at 202 (e.g., downhole tool 100 may be rotated with drill string 30 in borehole 42 as shown on FIG. 1). At 204, at least one standoff measurement and a corresponding tool azimuth measurement are acquired. In one exemplary embodiment, one or more sets of standoff measurements may be acquired at corresponding instants in time with each set of standoff measurements including standoff measurements acquired at each of a plurality of standoff sensors (e.g., three as described above with respect to FIG. 3). For example, a first set of standoff measurements may be acquired at a first time, a second set of standoff measurements may be acquired at a second time, and a third set of standoff measurements may be acquired at a third time. Tool azimuth measurements may be optionally determined for each set of standoff measurements such that each set is assigned a tool azimuth. Optional LWD sensor measurements may also be acquired at 206. Such LWD sensor measurements may be utilized, for example, to estimate the azimuthal dependence of a borehole parameter as described in more detail below. A borehole azimuth may then be determined at 208 by processing the standoff measurement(s) and tool azimuth(s). Such processing may include, for example, substituting standoff measurements and tool azimuths into a system of equations that may be solved for one or more previously unknown borehole azimuths, for example, borehole azimuths corresponding to each of the standoff measurements acquired at 204 or the LWD measurement(s) acquired at 206. At 210, the borehole azimuths and optional LWD measurements may optionally be utilized to estimate the azimuthal dependence of a borehole parameter and/or form a borehole image of such a borehole parameter. The results are then typically transmitted to the surface and/or stored in memory.

Borehole Azimuth Determination

Figure 5:
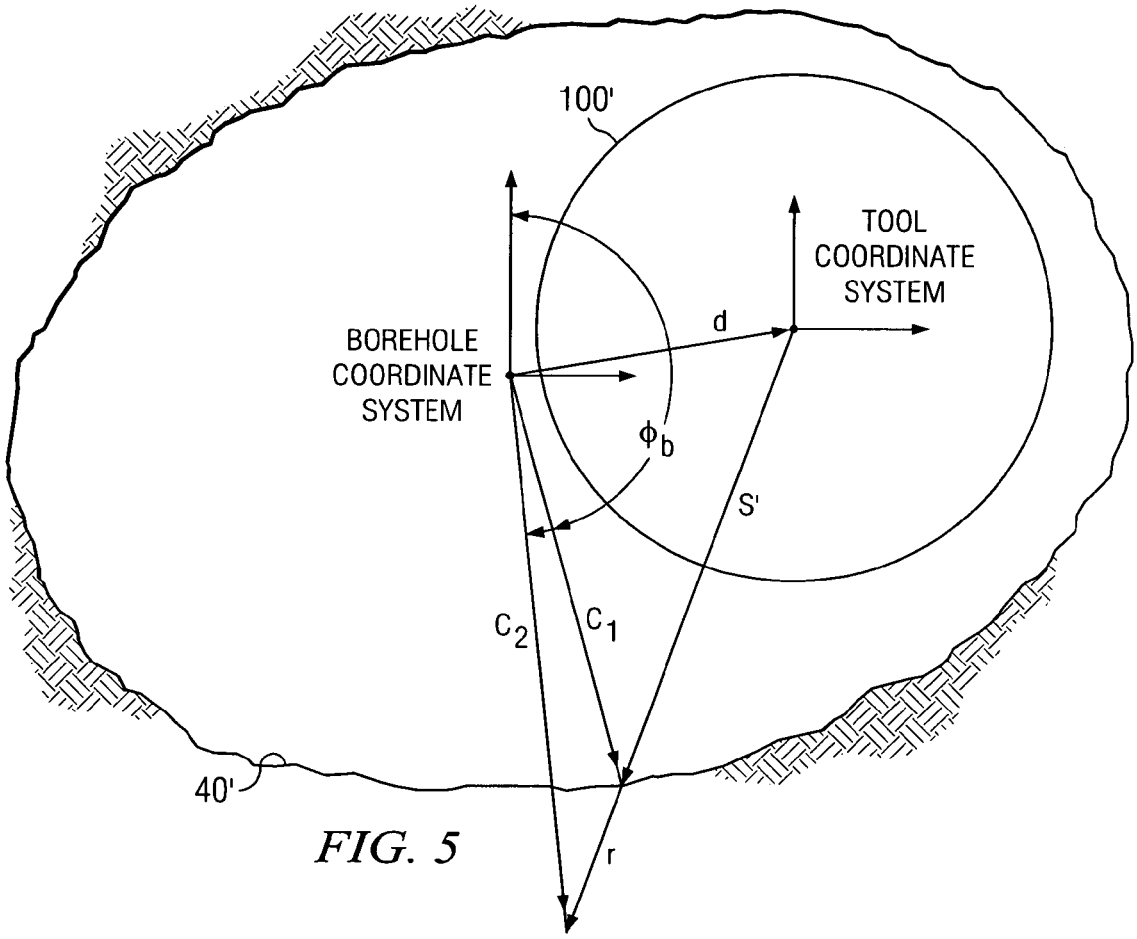
FIGS. 5 and 6 depict, in schematic form, cross sections of an exemplary measurement tool suitable for use with exemplary methods of this invention deployed in an exemplary borehole.

With reference now to FIG. 5, a schematic of a cross section of a downhole tool 100' deployed in a borehole 40' is shown (e.g., tool 100 shown deployed in borehole 40 on FIG. 1). The borehole azimuth may be determined, for example, via a vector addition of the lateral displacement vector d and the standoff vector s' as represented mathematically below:

$$c_1 = d + s' \qquad \text{Equation 1}$$

where $c_1$ represents the borehole vector, the direction of which is the borehole azimuth, d represents the lateral displacement vector between the borehole and tool coordinate systems, and s' represents the stand off vector, the direction of which is the tool azimuth at the standoff sensor. The borehole azimuth may then be determined from the borehole vector, for example, as follows:

$$\phi_b = Im(\ln(c_1)) \qquad \text{Equation 2}$$

where $c_1$ represents the borehole vector as described above, $\phi_b$ represents the borehole azimuth, the operator Im( ) designates the imaginary part, and the operator ln( ) represents the complex-valued natural logarithm such that Im(ln($c_1$)) is within a range of $2\pi$ radians, such as $-\pi < Im(\ln(c_1)) \leqq \pi$. Thus, according to Equations 1 and 2, the borehole azimuth, $\phi_b$, may be determined based upon lateral displacement vector and standoff vector inputs. The lateral displacement vector and the standoff vector may be determined via substantially any suitable technique, such as from standoff measurements and tool azimuth measurements as described in more detail below. In one exemplary embodiment, a standoff measurement, a tool azimuth measurement, and the tool diameter may be utilized to determine a standoff vector. In an alternative exemplary embodiment, a tool azimuth measurement, a known lateral displacement vector, and a known borehole parameter vector (defining the shape and orientation of the borehole cross section) may be utilized to determine a standoff vector. It will be appreciated that in such an alternative embodiment, a standoff vector may be determined without the use of a standoff measurement. It will also be appreciated that, as shown in FIG. 5 and as referred to herein, the magnitude of the standoff vector s' is the sum of the tool diameter and a measured standoff distance between a standoff sensor and the borehole wall.

As stated above, with respect to FIG. 4, the borehole azimuths may optionally be utilized to estimate the azimuthal dependence of a borehole parameter, for example in forming a borehole image. It will be appreciated by the artisan of ordinary skill that many LWD techniques utilized to measure such borehole parameters transmit energy that penetrates the formation (i.e., extends into the formation beyond the borehole wall). For example, electrical signals transmitted into a formation during LWD resistivity measurements typically penetrate some distance into the formation. Such distances are known to depend, for example, on the strength of the electrical signal and the electrical properties of the formation and may be estimated via known techniques in the prior art. For certain applications, it may be advantageous to take such formation penetration distances into account in determining the borehole azimuth. With further reference to FIG. 5, the borehole vector may be expressed mathematically as follows:

$$c_2=d+s'+f \qquad \text{Equation 3}$$

where $c_2$ represents the borehole vector, the direction of which is the borehole azimuth, d and s' represent the lateral displacement and standoff vectors, respectively, as described above, and f represents the formation penetration vector. The borehole azimuth may then be determined, for example, by substituting $c_2$ into Equation 2 for $c_1$. Such borehole azimuth values may then be utilized, for example, to register azimuthally sensitive LWD sensor data, as described in more detail below.

Lateral Displacement Vector and Borehole Parameter Vector Determination

In the discussion that follows, a methodology for determining (i) a lateral displacement vector between the borehole and tool coordinate systems and (ii) a borehole parameter vector is presented. Such methodology includes acquiring a plurality of standoff measurements and substituting them into a system of equations that may be solved for the borehole parameter vector and/or the lateral tool displacement vector. In one particular advantageous embodiment, the methodology includes acquiring a plurality of sets of standoff measurements (e.g., three) at a corresponding plurality of times, each set including multiple standoff measurements acquired via multiple standoff sensors (e.g., three). The standoff measurements may then be substituted into a system of equations that may be solved for both the borehole parameter vector (e.g., the major and minor axes and orientation of an ellipse) and an instantaneous lateral displacement vector at each of the plurality of times. As will also be described, for applications in which the size and shape of the borehole are known (or may be suitably estimated), a single set of standoff measurements may be utilized to determine the lateral displacement vector. As described above, the lateral displacement vector (along with the standoff vector and the formation penetration vector) may be utilized to determine the borehole azimuth. Alternatively, for certain exemplary applications in which the formation penetration vector may be approximated to have zero magnitude (as shown in Equation 1), the system of equations may also be solved directly for the borehole azimuth at each standoff sensor for each of the sets of standoff measurements.

Figure 6:
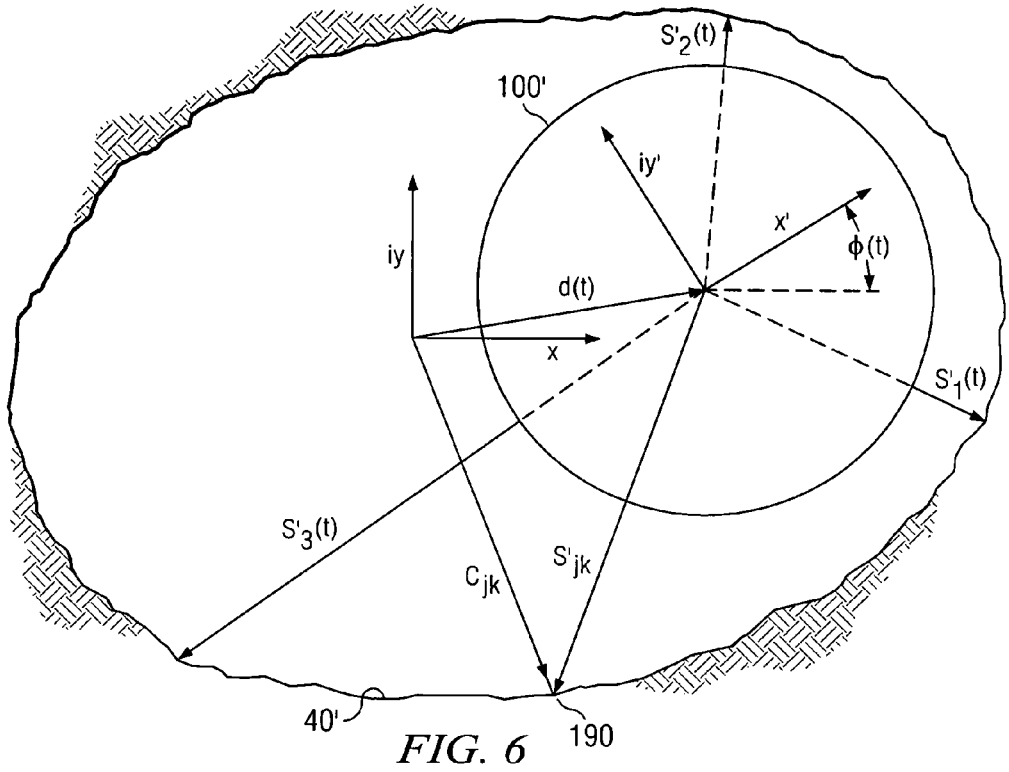

With reference now to FIG. 6, another schematic of a cross section of downhole tool 100' deployed in borehole 40' is shown. The downhole tool 100' includes a plurality of standoff sensors (not shown on FIG. 6) deployed thereon (e.g., as described above with respect to FIGS. 1 through 3). In the embodiment shown, borehole 40' is represented as having an elliptical cross section, however it will be appreciated that substantially any borehole shape may be evaluated. For mathematical convenience, borehole and tool coordinate systems are taken to be complex planes in which various vectors therein may be represented as complex numbers. The borehole and tool coordinate systems may be represented mathematically as follows:

$$w=x+iy \qquad \text{Equation 4}$$

$$w'=x'+iy' \qquad \text{Equation 5}$$

where w and w' represent the reference planes of the borehole and downhole tool, respectively, x and y represent Cartesian coordinates of the borehole reference plane, x' and y' represent Cartesian coordinates of the downhole tool 100' reference plane, and i represents a square root of the integer −1. At any instant in time, t, the coordinates of a vector in one coordinate system (e.g., the tool coordinate system) may be transformed to the other coordinate system (e.g., the borehole coordinate system) as follows:

$$w=w'\exp(i\phi(t))+d(t) \qquad \text{Equation 6}$$

where d(t) represents an unknown, instantaneous lateral displacement vector between the borehole and tool coordinate systems, and where $\phi(t)$ represents an instantaneous tool azimuth. As shown in Equation 6, the lateral displacement vector is a vector quantity that defines a magnitude and a direction between the tool and borehole coordinate systems in a plane substantially perpendicular to the longitudinal axis of the borehole. For example, in one embodiment, the lateral displacement vector may be defined as the magnitude and direction between the center point of the tool and the center point of the borehole in the plane perpendicular to the longitudinal axis of the borehole. As described in more detail herein, $\phi(t)$ may be measured in certain embodiments of this invention (e.g., using one or more azimuth sensors deployed on the tool 100'). In certain other embodiments of this invention, $\phi(t)$ may be treated as an unknown with its instantaneous values being determined from the standoff measurements. The invention is not limited in this regard.

With continued reference to FIG. 6, $s'_j(t)$, where j=1, . . . , n represent instantaneous standoff vectors from the n standoff sensors mounted on the tool 100'. As described above with respect to FIGS. 1 through 3, certain advantageous embodiments of downhole tool 100' include n=3 standoff sensors, however, the invention is not limited in this regard. The tool 100' may include substantially any number of standoff sensors. For example, as described in more detail below, certain other embodiments of downhole tool 100' may advantageously include n=4 standoff sensors.

With further reference to FIG. 6, borehole 40' may be represented mathematically by a simple closed curve as follows:

$$c(\bar{p},\tau)=u(\bar{p},\tau)+iv(\bar{p},\tau) \qquad \text{Equation 7}$$

where u and v define the general functional form of the borehole (e.g., circular, elliptical, etc.), $\tau$ represents the angular position around the borehole (i.e., the borehole azimuth) such that: $0 \leqq \tau < 1$, and $\bar{p}$ represents the borehole parameter vector, $\bar{p}=[p_1, \ldots, p_q]^T$, including the q unknown borehole parameters that define the shape and orientation of the borehole cross-section. For example, a circular borehole includes a parameter vector having one unknown borehole parameter (the radius of the circle), while an elliptical borehole includes a parameter vector having three unknown borehole parameters (the major and minor axes of the ellipse and the angular orientation of the ellipse). It will be appreciated that exemplary embodiments of this invention enable borehole parameter vectors having substantially any number, q, of unknown borehole parameters to be determined.

With continued reference to FIG. 6, sets of standoff measurements may be acquired at substantially any number of instants in time, each set including a standoff measurement acquired from each standoff sensor. Such standoff measurements may be represented as $s'_{jk}=s'_j(t_k)$ for times $t=t_k$, where $k=1, \ldots, m$. Tool azimuth measurements may also be acquired at substantially the same instants in time as the sets of standoff measurements and may be represented as $\phi_k=\phi(t_k)$. Since $s'_{jk}$ and $c_{jk}=c(\bar{p},\tau_j(t_k))$ terminate at the same point on the borehole wall (point 190 on FIG. 6), $s'_{jk}$ and $c_{jk}$ may be substituted into Equation 6, which yields the following system of coupled nonlinear equations:

$$d_k+s'_{jk}\exp(i\phi_k)-c_{jk}=0 \qquad \text{Equation 8}$$

where, as described above, $d_k$ represent the lateral displacement vectors at each instant in time k, $\phi_k$ represent the tool azimuths at each instant in time k, and $s'_{jk}$ and $c_{jk}$ represent the standoff vectors and borehole vectors, respectively, for each standoff sensor j at each instant in time k. It will be appreciated that Equation 8 represents a system of n times m complex-valued, nonlinear equations (or 2mn real-valued nonlinear equations) where n represents the number of standoff sensors (such that $j=1, \ldots, n$), and m represents the number of sets of standoff measurements (such that $k=, \ldots, m$). It will also be appreciated that for embodiments in which $\phi_k$ is known (e.g., measured via an azimuth sensor), Equation 8 includes $m(n+2)+q$ unknowns where q represents the number of unknown borehole parameters.

Equations 8 may be solved for the unknown parameter vector $\bar{p}$, the lateral displacement vectors $d_k$, and the auxiliary variables $\tau_{jk}=\tau_j(t_k)$, provided that the number of independent real-valued equations in Equation 8 is greater than or equal to the number of unknowns. It will be appreciated that the auxiliary variables $\tau_{jk}$ represent the borehole azimuths at each standoff sensor j at each instant in time k when the magnitude of the formation penetration vector f is substantially zero. As described above, at each instant in time k at which a set of n standoff measurements is acquired, 2n (real-valued) equations result. However, only n+2 unknowns are introduced at each instant in time k (n auxiliary variables plus the two unknowns that define the lateral displacement vector). Consequently, it is possible to accumulate more equations than unknowns provided that $2n>n+2$ (i.e., for embodiments including three or more standoff sensors). For example, an embodiment including three standoff sensors accumulates one more equation than unknown at each instant in time k. Thus for an embodiment including three standoff sensors, as long as $m \geqq q$ (i.e., the number of sets of standoff measurements is greater than or equal to the number of unknown borehole parameters) it is possible to solve for the parameter vector of a borehole having substantially any shape.

In one exemplary serviceable embodiment of this invention, a downhole tool including three ultrasonic standoff sensors deployed about the circumference of the tool rotates in a borehole with the drill string. The standoff sensors may be configured, for example, to acquire a set of substantially simultaneous standoff measurements over an interval of about 10 milliseconds. The duration of each sampling interval is preferably substantially less than the period of the tool rotation in the borehole (e.g., the sampling interval may be about 10 milliseconds, as stated above, while the rotational period of the tool may be about 0.5 seconds). Meanwhile, the azimuth sensor measures the tool azimuth, and correspondingly the azimuth at each of the standoff sensors, as the tool rotates in the borehole. A tool azimuth is then assigned to each set of standoff measurements. The tool azimuth is preferably measured at each interval, or often enough so that it may be determined for each set of standoff measurements, although the invention is not limited in this regard.

Upon acquiring the ultrasonic standoff measurements, the unknown borehole parameter vector and the lateral tool displacements may be determined as described above. For example, in this exemplary embodiment, it may be assumed that the borehole is substantially elliptical in cross section (e.g., as shown on FIG. 6). An elliptical borehole may be represented mathematically by a simple closed curve as follows:

$$c(\bar{p},\tau)=(a\cos(2\pi\tau)+ib\sin(2\pi\tau))\exp(i\Omega) \qquad \text{Equation 9}$$

where $0 \leqq \tau < 1$, $a>b$, and $0 \leqq \Omega < \pi$. The parameter vector for such an ellipse may be defined as $\bar{p}=[a,b,\Omega]^T$ where a, b, and $\Omega$ represent the q=3 unknown borehole parameters of the elliptical borehole, the major and minor axes and the angular orientation of the ellipse, respectively. Such borehole parameters may be determined by making m=3 sets of standoff measurements using a downhole tool including n=3 ultrasonic standoff sensors (e.g., as shown on FIG. 3), which yields the following system of equations:

$$d_1+s'_{11}\exp(i\phi_1)-c_{11}=0$$

$$d_1+s'_{12}\exp(i\phi_1)-c_{12}=0$$

$$d_1+s'_{13}\exp(i\phi_1)-c_{13}=0$$

$$d_2+s'_{21}\exp(i\phi_2)-c_{21}=0$$

$$d_2+s'_{22}\exp(i\phi_2)-c_{22}=0$$

$$d_2+s'_{23}\exp(i\phi_2)-c_{23}=0$$

$$d_3+s'_{31}\exp(i\phi_3)-c_{31}=0$$

$$d_3+s'_{32}\exp(i\phi_3)-c_{32}=0$$

$$d_3+s'_{33}\exp(i\phi_3)-c_{33}=0 \qquad \text{Equation 10}$$

where d, s', $\phi$, and c are as defined above with respect to Equation 8. Substituting Equation 9 into Equation 10 yields the following:

$$d_1+s'_{11}\exp(i\phi_1)=(a\cos(2\pi\tau_{11})+ib\sin(2\pi\tau_{11}))\exp(i\Omega)$$

$$d_1+s'_{12}\exp(i\phi_1)=(a\cos(2\pi\tau_{12})+ib\sin(2\pi\tau_{12}))\exp(i\Omega)$$

$$d_1+s'_{13}\exp(i\phi_1)=(a\cos(2\pi\tau_{13})+ib\sin(2\pi\tau_{13}))\exp(i\Omega)$$

$$d_2+s'_{21}\exp(i\phi_2)=(a\cos(2\pi\tau_{21})+ib\sin(2\pi\tau_{21}))\exp(i\Omega)$$

$$d_2+s'_{22}\exp(i\phi_2)=(a\cos(2\pi\tau_{22})+ib\sin(2\pi\tau_{22}))\exp(i\Omega)$$

$$d_2+s'_{23}\exp(i\phi_2)=(a\cos(2\pi\tau_{23})+ib\sin(2\pi\tau_{23}))\exp(i\Omega)$$

$$d_3+s'_{31}\exp(i\phi_3)=(a\cos(2\pi\tau_{31})+ib\sin(2\pi\tau_{31}))\exp(i\Omega)$$

$$d_3+s'_{32}\exp(i\phi_3)=(a\cos(2\pi\tau_{32})+ib\sin(2\pi\tau_{32}))\exp(i\Omega)$$

$$d_3+s'_{33}\exp(i\phi_3)=(a\cos(2\pi\tau_{33})+ib\sin(2\pi\tau_{33}))\exp(i\Omega) \qquad \text{Equation 11}$$

As described above with respect to Equation 8, Equation 11 includes 18 real-valued equations (2mn) and 18 unknowns (m(n+2)+q). Equation 11 may thus be solved simultaneously for the parameter vector $\bar{p}=[a,b,\Omega]^T$, the unknown lateral displacement vectors $d_1$, $d_2$, and $d_3$ (each of which includes a real and an imaginary component and thus constitutes two unknowns), and the borehole azimuths $\tau_{11}$, $\tau_{12}$, $\tau_{13}$, $\tau_{21}$, $\tau_{22}$, $\tau_{23}$, $\tau_{31}$, $\tau_{32}$, and $\tau_{33}$. It will be appreciated that Equation 11 may be solved (with the parameter vector, lateral displacements, and borehole azimuths being determined) using substantially any known suitable mathematical techniques. For example, Equation 11 may be solved using the nonlinear least squares technique. Such numerical algorithms are available, for example, via commercial software such as Mathematica® (Wolfram Research, Inc., Champaign, Ill.). Nonlinear least squares techniques typically detect degeneracies in the system of equations by detecting degeneracies in the Jacobian matrix of the transformation. If degeneracies are detected in solving Equation 11, the system of equations may be augmented, for example, via standoff measurements collected at additional instants of time until no further degeneracies are detected. Such additional standoff measurements effectively allow the system of equations to be over-determined and therefore more easily solved (e.g., including 24 equations and 23 unknowns when four sets of standoff measurements are utilized or 30 equations and 28 unknowns when five sets of standoff measurements are utilized).

It will, of course, be appreciated that techniques for solving the above described systems of non-linear equations (such as the above described nonlinear least squares technique) typically require an initial estimate to be made of the solutions to the system of nonlinear equations. The need for such an initial estimate will be readily apparent to those of ordinary skill in the art. Methodologies for determining and implementing such initial estimates are also well understood by those of ordinary skill in the art.

As stated above, in applications in which the size and shape of the borehole is known (or may be suitable estimated), only a single set of standoff measurements is typically required to determine the lateral displacement vector. Moreover, in typical drilling applications, the rate of penetration of the drill bit (typically in the range of from about 1 to about 100 feet per hour) is often slow compared to the angular velocity of the drill string and the exemplary measurement intervals described above. Thus in typically LWD applications it is not always necessary to continuously determine the borehole parameter vector. Rather, in many applications, it may be preferable to determine the borehole parameter vector at longer time intervals (e.g., at about 60 second intervals, which represents about a twelve-inch depth interval at a drilling rate of 60 feet per hour). At intermediate times, the borehole parameter vector may be assumed to remain substantially unchanged and the standoff measurements, azimuth measurements, and the previously determined borehole parameter vector, may be utilized to determine the lateral displacement of the tool in the borehole. For example, as shown in Equation 12 for a hypothetical elliptical borehole, the lateral displacement vector may be unambiguously determined in substantially real time via a single set of standoff sensor measurements as follows:

$$d_1+s'_{11}\exp(i\phi_1)=(a\cos(2\pi\tau_{11})+ib\sin(2\pi\tau_{11}))\exp(i\Omega)$$

$$d_1+s'_{12}\exp(i\phi_1)=(a\cos(2\pi\tau_{12})+ib\sin(2\pi\tau_{12}))\exp(i\Omega)$$

$$d_1+s'_{13}\exp(i\phi_1)=(a\cos(2\pi\tau_{13})+ib\sin(2\pi\tau_{13}))\exp(i\Omega)$$

where a, b, and $\Omega$ represent the previously determined borehole parameters, $d_1$ represents the lateral displacement vector, and $\tau_{11}$, $\tau_{12}$, and $\tau_{13}$ represent the borehole azimuths at each of the standoff sensors. It will be appreciated that Equation 12 includes 5 unknowns (the real and imaginary components of the lateral displacement vector $d_1$ and the borehole azimuths $\tau_{11}$, $\tau_{12}$, and $\tau_{13}$) and 6 real valued equations, and thus may be readily solved for $d_1$ as described above. It will also be appreciated that only two standoff measurements are required to unambiguously determine $d_1$ and that a system of equations including 4 unknowns and 4 real valued equations may also be utilized.

It will be appreciated that this invention is not limited to the assumption that the m standoff sensors substantially simultaneously acquire standoff measurements as in the example described above. In a typical acoustic standoff sensor arrangement, it is typically less complex to fire the transducers sequentially, rather than simultaneously, to save power and minimize acoustic interference in the borehole. For example, in one exemplary embodiment, the individual transducers may be triggered sequentially at intervals of about 2.5 milliseconds. In such embodiments, it may be useful to account for any change in azimuth that may occur during such an interval. For example, at an exemplary tool rotation rate of 2 full rotations per second, the tool rotates about 2 degrees per 2.5 milliseconds. In such embodiments, it may be useful to measure the tool azimuth for each stand off sensor measurement. The system of complex, nonlinear equations shown above in Equation 8 may then alternatively be expressed as:

$$d_k+s'_{jk}\exp(i\phi_{jk})-c_{jk}=0 \qquad \text{Equation 13}$$

where $d_k$, $s'_{jk}$, and $c_{jk}$ are as defined above with respect to Equation 8, and $\phi_{jk}$ represents the tool azimuth at each standoff sensor j at each instant in time k. Equation 13 may then be solved, for example, as described above with respect to Equations 8 through 11 to determine the borehole parameter vector and the lateral tool displacements. It will be appreciated that this invention is not limited to any particular time intervals or measurement frequency.

For certain applications, an alternative embodiment of the downhole tool including n=4 standoff sensors may be advantageously utilized. In such an alternative embodiment, the standoff sensors may be deployed, for example, at 90-degree intervals around the circumference of the tool. Such an embodiment may improve tool reliability, since situations may arise during operations in which redundancy is advantageous to obtain three reliable standoff measurements at some instant in time. For example, the tool may include a sensor temporarily in a failed state, or at a particular instant in time a sensor may be positioned too far from the borehole wall to give a reliable signal. Moreover, embodiments including n=4 standoff sensors enable two more equations than unknowns to be accumulated at each instant in time k. Thus for an embodiment including four standoff sensors, as long as $m \geqq q/2$ (i.e., the number of sequential measurements is greater than or equal to one half the number of unknown borehole parameters) it is possible to solve for the parameter vector of a borehole having substantially any shape. For example, only two sets of standoff measurements are required to determine the parameter vector of an elliptical borehole. Alternatively, three sets of standoff measurements may be utilized to provide an over-determined system of complex, nonlinear equations, which may be more easily solved using conventional nonlinear least squares techniques.

One other advantage to utilizing a downhole tool having n=4 standoff sensors is that the tool azimuth does not need to be measured. It will be appreciated that in embodiments in which the tool azimuth $\phi_k$ is unknown, Equation 8 includes m(n+3)+q unknowns. Consequently, in such embodiments, it is possible to accumulate more equations than unknowns provided that 2n>n+3 (i.e., for embodiments including four or more standoff sensors). Thus for an embodiment including n=4 standoff sensors, as long as $m \geqq q$ (i.e., the number of sequential measurements is greater than or equal to the number of unknown borehole parameters) it is possible to solve for the parameter vector of a borehole having substantially any shape as well as the tool azimuth and lateral displacement vector at each interval.

Although particular embodiments including n=3 and n=4 standoff sensors are described above, it will be appreciated that this invention is not limited to any particular number of standoff sensors. It will also be appreciated that there is a tradeoff with increasing the number of standoff sensors. While increasing the number of standoff sensors may provide some advantages, such as those described above for embodiments including n=4 standoff sensors, such advantages may be offset by the increased tool complexity, which tends to increase both fabrication and maintenance costs, and may also reduce tool reliability in demanding downhole environments.

Borehole Imaging

In general an image may be thought of as a two-dimensional representation of a parameter value determined at discrete positions. For the purposes of this disclosure, borehole imaging may be thought of as a two-dimensional representation of a measured formation (or borehole) parameter at discrete azimuths and borehole depths. Such borehole images thus convey the dependence of the measured formation (or borehole) parameter on the azimuth and depth. It will therefore be appreciated that one purpose in forming such images of particular formation or borehole parameters (e.g., formation resistivity, dielectric constant, density, acoustic velocity, etc.) is to determine the actual azimuthal dependence of such parameters as a function of the borehole depth. Determination of the actual azimuthal dependence may enable a value of the formation parameter to be determined at substantially any arbitrary azimuth, for example via interpolation. The extent to which a measured image differs from the actual azimuthal dependence of a formation parameter may be thought of as image distortion. Such distortion may be related, for example, to statistical measurement noise, aliasing, and/or other effects, such as misregistration of LWD sensor data. As stated above, prior art imaging techniques that register LWD data with a tool azimuth are susceptible to such misregistration and may therefore inherently generate distorted LWD images. It will be appreciated that minimizing image distortion advantageously improves the usefulness of borehole images in determining the actual azimuthal dependence of such borehole parameters.

With reference again to FIG. 4, exemplary embodiments of this invention include correlating azimuthally sensitive LWD measurements with a borehole azimuth to form a borehole image. It will be appreciate that substantially any technique may be utilized for such a correlation. For example, LWD sensor data (e.g., gamma ray counts) may be grouped into azimuthal bins, such as quadrants, octants, or some other suitable azimuthal sector. As the tool rotates about its longitudinal axis, data are acquired by a sensor and grouped into various azimuthal sectors based on the borehole azimuth of the sensor. During subsequent revolutions sensor data grouped into any particular sector may be averaged, for example, with sensor data acquired during earlier revolutions. It will be appreciated that while such "binning" techniques are know in the prior art (for example as disclosed by Holenka et al. in U.S. Pat. No. 5,473,158, Edwards et al. in U.S. Pat. No. 6,307,199, Kurkoski in U.S. Pat. No. 6,584,837, and Spross in U.S. Pat. No. 6,619,395), utilization of the borehole azimuth as disclosed herein tends to minimize misregistration errors and therefore improve such prior art imaging techniques. Image distortion may be further reduced via convolving the correlated sensor data with a window function as described in more detail below. In this manner, image distortion resulting from statistical measurement noise, aliasing, and misregistration of the sensor data may be minimized.

Figure 7:
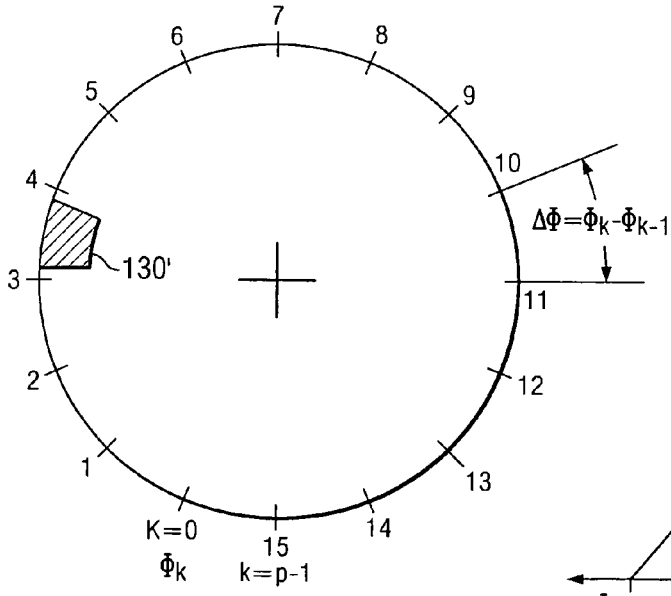
FIG. 7 depicts, in schematic form, a cross section of an exemplary LWD tool suitable for use in accordance with aspects of this invention.

Turning now to FIG. 7, a schematic of a cross section of a downhole tool (e.g., tool 100 shown on FIG. 1) is shown. The tool includes an LWD sensor 130' (such as a gamma ray sensor) deployed thereon. In general, the borehole may be represented by a plurality of discrete azimuthal positions. Typically, embodiments including 8 to 32 azimuthal positions are preferred (the embodiment shown in FIG. 7 includes 16 discrete azimuthal positions denoted as 0 through 15). However, the invention is not limited in this regard, as substantially any number of discrete azimuthal positions may be utilized. It will be appreciated that there is a tradeoff with increasing the number of azimuthal positions. Image quality (and in particular azimuthal resolution) tends to improve with increasing number of azimuthal positions at the expense of requiring greater communication bandwidth between the downhole tool and the surface and/or greater data storage capacity. Moreover, utilization of conventional binning techniques may lead to a degradation of the statistical properties of the binned data as the number of azimuthal positions increases.

With continued reference to FIG. 7, and assuming that the azimuthal positions are uniformly distributed about the circumference of the borehole, the borehole azimuth at each discrete azimuthal position, $\phi_k$, and the subtended circular angle between adjacent azimuthal positions, $\Delta\phi$, may be expressed mathematically, for example, as follows:

$$\phi_k = \frac{2\pi}{p}k + \pi\left(\frac{2}{p} - 1\right),\ k = 0, \ldots, p-1 \qquad \text{Equation 14}$$

$$\Delta\phi = \phi_k - \phi_{k-1} = \frac{2\pi}{p} \qquad \text{Equation 15}$$

where the subscript k is used to represent the individual azimuthal positions and p represents the number of azimuthal positions about the circumference of the tool. While the above equations assume that the azimuthal positions are evenly distributed about the circumference of the tool, the invention is not limited in this regard. For example, if a heterogeneity in a formation is expected on one side of a borehole (e.g., from previous knowledge of the strata), the azimuthal positions may be chosen such that $\Delta\phi$ on that side of the borehole is less than $\Delta\phi$ on the opposing side of the borehole.

As described briefly above, exemplary embodiments of this invention include convolving azimuthally sensitive sensor data with a predetermined window function. The azimuthal dependence of a measurement sensitive to a formation parameter may be represented by a Fourier series, for example, shown mathematically as follows:

$$F(\phi) = \sum_{v=-\infty}^{+\infty} f_v \exp(iv\phi) \qquad \text{Equation 16}$$

where the Fourier coefficients, $f_v$, are expressed as follows:

$$f_v = \frac{1}{2\pi}\int_{-\pi}^{\pi} F(\phi)\exp(-iv\phi)\,d\phi \qquad \text{Equation 17}$$

and where $\phi$ represents the borehole azimuth, $F(\phi)$ represents the azimuthal dependence of a measurement sensitive to a formation (or borehole) parameter, and i represents the square root of the integer −1.

Given a standard mathematical definition of a convolution, the convolution of the sensor data with a window function may be expressed as follows:

$$\tilde{F}_k = \tilde{F}(\phi_k) = \frac{1}{2\pi}\int_{-\pi}^{+\pi} F(\phi)W(\phi_k - \phi)\,d\phi \qquad \text{Equation 18}$$

where $\phi$ and $F(\phi)$ are defined above with respect Equation 17, $\tilde{F}_k$ and $\tilde{F}(\phi_k)$ represent the convolved sensor data stored at each discrete azimuthal position, and $W(\phi_k-\phi)$ represents the value of the predetermined window function at each discrete azimuthal position, $\phi_k$, for a given borehole azimuth, $\phi$. For simplicity of explanation of this embodiment, the window function itself is taken to be a periodic function such that $W(\phi)=W(\phi+2\pi l)$ where $l=\ldots,-1,0,+1,\ldots,$ is any integer. However, it will be appreciated that use of periodic window functions is used here for illustrative purposes, and that the invention is not limited in this regard.

Based on Equations 16 through 18, it follows that:

$$\tilde{F}_k = \sum_{v=-\infty}^{+\infty} f_v w_v \exp(iv\phi_k),\ k = 0, \ldots, p-1 \qquad \text{Equation 19}$$

where from Equation 15:

$$w_v = \frac{1}{2\pi}\int_{-\pi}^{+\pi} W(\phi)\exp(-iv\phi)\,d\phi \qquad \text{Equation 20}$$

where $w_v$ represents the Fourier coefficients of $W(\phi)$, $f_v$ represents the Fourier coefficients of $F(\phi)$ and is given in Equation 17, $W(\phi)$ represents the azimuthal dependence of the window function, and, as described above, $F(\phi)$ represents the azimuthal dependence of the measurement that is sensitive to the formation parameter. It will be appreciated that the form of Equation 19 is consistent with the mathematical definition of a convolution in that the Fourier coefficients for a convolution of two functions equal the product of the Fourier coefficients for the individual functions.

It will be appreciated that embodiments of this invention may utilize substantially any window function, $W(\phi)$. Suitable window functions typically include predetermined values that are expressed as a function of the angular difference between the discrete azimuthal positions, $\phi_k$, and an arbitrary borehole azimuth, $\phi$. For example, in one exemplary embodiment, the value of the window function is defined to be a constant within a range of borehole azimuths (i.e., a window) and zero outside the range. Such a window function is referred to as a rectangular window function and may be expressed, for example, as follows:

$$W(\phi) = \begin{cases} 2\pi p, & |\phi| < \frac{x\pi}{p} \\ 0, & \frac{x\pi}{p} \le \phi < \pi \\ 0, & -\pi \le \phi \le -\frac{x\pi}{p} \end{cases} \qquad \text{Equation 21}$$

where p represents the number of azimuthal positions for which convolved logging sensor data is determined, $\phi$ represents the borehole azimuth, and x is a factor controlling the azimuthal breadth of the window function $W(\phi)$. While Equation 21 is defined over the interval $-\pi \leqq \phi < \pi$, it is understood that $W(\phi)$ has the further property that it is periodic: $W(\phi)=W(\phi+2\pi l)$ for any integer l.

Figure 8:
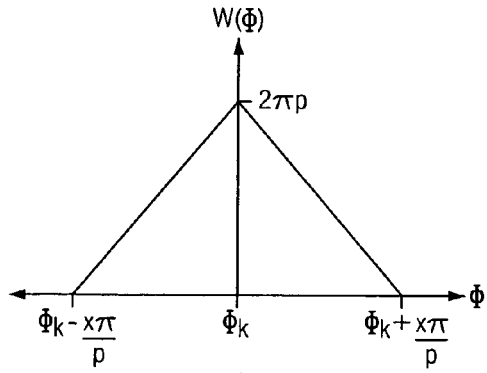
FIG. 8 depicts an exemplary Bartlett window function.

In certain embodiments it may be advantageous to utilize tapered and/or symmetrical window functions. A Bartlett function (i.e., a triangle function), such as that shown on FIG. 8, is one example of a symmetrical and tapered window function that is relatively simple and thus a good choice for illustrating exemplary advantages of this invention. As shown in FIG. 8, and as used herein, a symmetrical window function is one in which the value of the window function is an even function of its argument. A tapered window function is one in which the value of the window function decreases with increasing angular difference, $|\phi_k-\phi|$, between a discrete azimuthal position, $\phi_k$, and a borehole azimuth, $\phi$. It will be appreciated that such tapered window functions tend to weight the measured sensor data based on its corresponding borehole azimuth, with sensor data acquired at or near a borehole azimuth of $\phi_k$ being weighted more heavily than sensor data acquired at a borehole azimuth further away from $\phi_k$. Setting $\phi_k=0$, one exemplary Bartlett window function may be expressed, for example, as follows:

$$W(\phi) = \begin{cases} 2\pi p\left(1 - \frac{p|\phi|}{x\pi}\right), & |\phi| < \frac{x\pi}{p} \\ 0, & \frac{x\pi}{p} \le \phi < \pi \\ 0, & -\pi \le \phi \le -\frac{x\pi}{p} \end{cases} \qquad \text{Equation 22}$$

where p, $\phi$, and x are as described above with respect to Equation 21. In Equation 22, $W(\phi)$ has the same exemplary periodicity mentioned in the discussion of Equation 21.

In addition to the Bartlett function described above, other exemplary symmetrical and tapered window functions include, for example, Blackman, Gaussian, Hanning, Hamming, and Kaiser functions, exemplary embodiments of which are expressed mathematically as follows in Equations 23, 24, 25, 26, and 27, respectively:

$$W(\phi)=\begin{cases} 2\pi p\left[0.42+0.5\cos\left(\frac{p\phi}{x}\right)+0.08\cos\left(2\frac{p\phi}{x}\right)\right], & |\phi|<\frac{x\pi}{p} \\ 0, & \frac{x\pi}{p}\le\phi<\pi \\ 0, & -\pi\le\phi\le-\frac{x\pi}{p} \end{cases} \quad \text{Equation 23}$$

$$W(\phi)=\begin{cases} \exp\left(-\alpha_a\left(\frac{p\phi}{x\pi}\right)^2\right), & |\phi|<\frac{x\pi}{p} \\ 0, & \frac{x\pi}{p}\le\phi<\pi \\ 0, & -\pi\le\phi\le-\frac{x\pi}{p} \end{cases} \quad \text{Equation 24}$$

$$W(\phi)=\begin{cases} \pi p\left(1+\cos\left(\frac{p\phi}{x\pi}\right)\right), & |\phi|<\frac{x\pi}{p} \\ 0, & \frac{x\pi}{p}\le\phi<\pi \\ 0, & -\pi\le\phi\le-\frac{x\pi}{p} \end{cases} \quad \text{Equation 25}$$

$$W(\phi)=\begin{cases} 2\pi p\left[0.54+0.46\cos\left(\frac{p\phi}{x}\right)\right], & |\phi|<\frac{x\pi}{p} \\ 0, & \frac{x\pi}{p}\le\phi<\pi \\ 0, & -\pi\le\phi\le-\frac{x\pi}{p} \end{cases} \quad \text{Equation 26}$$

$$W(\phi)=\begin{cases} \frac{I_0\left(\omega_a\sqrt{1-\left(\frac{p\phi}{x\pi}\right)^2}\right)}{I_0(\omega_a)}, & |\phi|<\frac{x\pi}{p} \\ 0, & \frac{x\pi}{p}\le\phi<\pi \\ 0, & -\pi\le\phi\le-\frac{x\pi}{p} \end{cases} \quad \text{Equation 27}$$

where p, x, and $\phi$ are as described above with respect to Equation 21, and $\alpha_a$ represents another factor selected to control the relative breadth of the window function, such as, for example, the standard deviation of a Gaussian window function. Typically, $\alpha_a$ is in the range from about 1 to about 2. $I_0$ represents a zero order modified Bessel function of the first kind and $\omega_a$ represents a further parameter that may be adjusted to control the breadth of the window. Typically, $\omega_a$ is in the range from about $\pi$ to about $2\pi$. It will be appreciated that Equations 21 through 27 are expressed independent of $\phi_k$ (i.e., assuming $\phi_k=0$) for clarity. Those of ordinary skill in the art will readily recognize that such equations may be rewritten in numerous equivalent or similar forms to include non zero values for $\phi_k$. In Equations 23 through 27, all the functions $W(\phi)$ also have the same exemplary periodicity mentioned in the discussion of Equations 21 and 22.

It will be appreciated that exemplary embodiments of this invention may be advantageously utilized to determine a formation (or borehole) parameter at substantially any arbitrary borehole azimuth. For example, Fourier coefficients of the azimuthal dependence of a formation parameter may be estimated, for example, by substituting the Bartlett window function given in Equation 22 into Equation 20 and setting x equal to 2, which yields:

$$\tilde{F}_k=\sum_{v=-\infty}^{+\infty}(-1)^v f_v \exp\left(\frac{i2\pi v(k+1)}{p}\right) sinc^2\left(\frac{\pi v}{p}\right), \quad k=0,\ldots,p-1 \quad \text{Equation 28}$$

where the subscript k is used to represent the individual azimuthal positions, and p represents the number of azimuthal positions for which convolved logging sensor data is determined. Additionally, $\tilde{F}_k$ represents the convolved sensor data stored at each azimuthal position k, $f_v$ represents the Fourier coefficients, and sin c(x)=sin(x)/x. A Fourier series including at least one Fourier coefficient may then be utilized to determine a value of the formation parameter at substantially any borehole azimuth $\phi$. The Fourier coefficient(s) may also be utilized to estimate $F(\phi)$ as described above with respect to Equations 16 and 17. It will be appreciated that the determination of the Fourier coefficients is not limited in any way to a Bartlett window function, but rather, as described above, may include the use of substantially any window function having substantially any azimuthal breadth.

In one exemplary serviceable embodiment of this invention, an energy source (e.g., a gamma radiation source) emits energy radially outward and in a sweeping fashion about the borehole as the tool rotates therein. Some of the gamma radiation from the source interacts with the formation and is detected at a gamma ray detector within the borehole. Typically the detector is also rotating with the tool. The sensor may be configured, for example, to average the detected radiation (the azimuthally sensitive sensor data) into a plurality of data packets, each acquired during a single rapid sampling period. The duration of each sampling period is preferably significantly less than the period of the tool rotation in the borehole (e.g., the sampling period may be about 10 milliseconds while the rotational period of the tool may be about 0.5 seconds). Meanwhile, the borehole azimuth may be determined as described above, for example via Equations 1 and 2. A suitable borehole azimuth is then assigned to each data packet. The borehole azimuth is preferably determined for each sampling period, although the invention is not limited in this regard.

The contribution of each data packet to the convolved sensor data given in Equation 18 may then be expressed as follows:

$$\frac{1}{2\pi}F(\gamma_j)W(\phi_k-\gamma_j),\quad k=0,\ldots,p-1 \qquad \text{Equation 29}$$

where $F(\gamma_j)$ represents the measured sensor data at the assigned borehole azimuth $\gamma_j$ and as described above $W(\phi_k-\gamma_j)$ represents the value of the predetermined window function at each assigned borehole azimuth $\gamma_j$.

Sensor data for determining the azimuthal dependence of the formation parameter (e.g., formation density) at a particular well depth is typically gathered and grouped during a predetermined time period. The predetermined time period is typically significantly longer (e.g., one thousand times) than the above described rapid sampling time. Summing the contributions to Equation 29 from N such data packets yields:

$$\tilde{F}_k=\frac{1}{2\pi N}\sum_{j=1}^{N}F(\gamma_j)W(\phi_k-\gamma_j),\quad k=0,\ldots,p-1 \qquad \text{Equation 30}$$

where $\tilde{F}_k$ represents the convolved sensor data stored at each discrete azimuthal position as described above with respect to Equation 18. The sum is normalized by the factor 1/N so that the value of $\tilde{F}_k$ is independent of N in the large N limit.

In the exemplary embodiment described, $\tilde{F}_k$, as given in Equation 30, represents the convolved sensor data for a single well depth. To form a two dimensional image (azimuthal position versus well depth), sensor data may be acquired at a plurality of well depths using the procedure described above. In one exemplary embodiment, sensor data may be acquired substantially continuously during at least a portion of a drilling operation. Sensor data may be grouped by time (e.g., in 10 second intervals) with each group indicative of a single well depth. In one exemplary embodiment, each data packet may be acquired in about 10 milliseconds. Such data packets may be grouped in about 10 second intervals resulting in about 1000 data packets per group. At a drilling rate of about 60 feet per hour, each group represents about a two-inch depth interval. It will be appreciated that this invention is not limited to any particular rapid sampling and/or time periods. Nor is this invention limited by the description of the above exemplary embodiments.

It will also be appreciated that embodiments of this invention may be utilized in combination with substantially any other known methods for correlating the above described time dependent sensor data with depth values of a borehole. For example, the $\tilde{F}_k$ values obtained in Equation 29 may be tagged with a depth value using known techniques used to tag other LWD data. The $\tilde{F}_k$ values may then be plotted as a function of azimuthal position and depth to generate an image.

It will be understood that the aspects and features of the present invention may be embodied as logic that may be processed by, for example, a computer, a microprocessor, hardware, firmware, programmable circuitry, or any other processing device well known in the art. Similarly the logic may be embodied on software suitable to be executed by a processor, as is also well known in the art. The invention is not limited in this regard. The software, firmware, and/or processing device may be included, for example, on a downhole assembly in the form of a circuit board, on board a sensor sub, or MWD/LWD sub. Alternatively the processing system may be at the surface and configured to process data sent to the surface by sensor sets via a telemetry or data link system also well known in the art. Electronic information such as logic, software, or measured or processed data may be stored in memory (volatile or non-volatile), or on conventional electronic data storage devices such as are well known in the art.

Although the present invention and its advantages have been described in detail, it should be understood that various changes, substitutions and alternations can be made herein without departing from the spirit and scope of the invention as defined by the appended claims.

I claim:

1. A method for estimating an azimuthal dependence of a parameter of a borehole using logging sensor measurements acquired as a function of a borehole azimuth of said logging sensors, the method comprising:

(a) rotating a downhole tool in a borehole, the tool including at least one logging sensor, at least one standoff sensor, and an azimuth sensor, data from the logging sensor being operable to assist determination of a parameter of the borehole;

(b) causing the at least one logging sensor to acquire a plurality of logging sensor measurements at a corresponding plurality of times;

(c) causing the at least one standoff sensor and the azimuth sensor to acquire a corresponding plurality of standoff measurements and tool azimuth measurements at the plurality of times;

(d) processing the standoff measurements and the azimuth measurements acquired in (c) to determine borehole azimuths at selected ones of the plurality of times; and (e) utilizing the plurality of logging sensor measurements acquired in (b) and the borehole azimuths determined (d) to estimate an azimuthal dependence of a parameter of the borehole.

2. The method of claim 1, wherein (e) further comprises grouping the plurality of logging sensor measurements acquired in (b) into a plurality of azimuthal sectors based upon the corresponding borehole azimuths determined in (d).

3. The method of claim 2, further comprising:

(f) repositioning the tool in the borehole and repeating (b), (c), (d), and (e); and (g) assigning a first borehole depth value to the logging sensor measurements grouped in (e) and a second borehole depth value to the logging sensor measurements grouped in (f).

4. The method of claim 1, wherein the logging sensor is selected from the group consisting of a natural gamma ray sensor, a neutron sensor, a density sensor, a resistivity sensor, a formation pressure sensor, an annular pressure sensor, an ultrasonic sensor, and an audio-frequency acoustic sensor.

5. A method for estimating an azimuthal dependence of a parameter of a borehole using logging sensor measurements acquired as a function of a borehole azimuth of said logging sensors, the method comprising:

(a) rotating a downhole tool in a borehole, the tool including at least one logging sensor, at least one standoff sensor, and an azimuth sensor, data from the logging sensor being operable to assist determination of a parameter of the borehole;

(b) causing the at least one logging sensor to acquire a plurality of logging sensor measurements at a corresponding plurality of times;

(c) causing the at least one standoff sensor and the azimuth sensor to acquire a corresponding plurality of standoff measurements and tool azimuth measurements at the plurality of times;

(d) processing the standoff measurements and the azimuth measurements acquired in (c) to determine borehole azimuth at selected ones of the plurality of times; and (e) processing a convolution of the logging sensor measurements acquired in (b) and the corresponding borehole azimuths determined in (d) at selected ones of the plurality of times with a window function to determine convolved logging sensor data for at least one azimuthal position about the borehole.

6. The method of claim 5, wherein the logging sensor is selected from the group consisting of a natural gamma ray sensor, a neutron sensor, a density sensor, a resistivity sensor, a formation pressure sensor, an annular pressure sensor, an ultrasonic sensor, and an audio-frequency acoustic sensor.

7. The method claim 5, wherein the parameter of the borehole is selected from the group consisting of formation density, formation resistivity, formation acoustic velocity, gamma ray interaction cross section, and neutron interaction cross section.

8. The method of claim 5, wherein the tool comprises a drill string.

9. The method of claim 5, wherein the tool comprises a logging while drilling tool.

10. The method of claim 5, wherein the tool further comprises a controller, the controller disposed to cause the at least one logging sensor to acquire the plurality of logging sensor measurements in (b) and the at least one standoff sensor and the azimuth sensor to acquire the corresponding plurality of standoff measurements and tool azimuth measurements in (c), the controller further disposed to determine the borehole azimuth in (d) and the convolved logging sensor data in (e).

11. The method of claim 5, wherein the window function comprises a rectangular window function.

12. The method of claim 11, wherein the rectangular window function is expressed mathematically as follows:

$$W(\phi)=\begin{Bmatrix} 2\pi p, & |\phi|<\frac{x\pi}{p} \\ 0, & \frac{x\pi}{p}\le\phi<\pi \\ 0, & -\pi\le\phi\le-\frac{x\pi}{p} \end{Bmatrix};$$

wherein W(ϕ) represents the rectangular window function, p represents the number of the azimuthal positions for which convolved logging sensor data is determined, ϕ represents the borehole azimuth, and x represents a factor controlling an azimuthal breadth of the window function.

13. The method of claim 5, wherein the window function is tapered and symmetrical about the at least one azimuthal position.

14. The method of claim 13, wherein the window function is selected from the group consisting of Bartlett, Blackman, Gaussian, Hanning, Hamming, and Kaiser functions.

15. The method of claim 14, wherein the window function is expressed mathematically by an equation selected from the group consisting of:

$$W(\phi)=\begin{Bmatrix} 2\pi p\left(1-\frac{p|\phi|}{x\pi}\right), & |\phi|<\frac{x\pi}{p} \\ 0, & \frac{x\pi}{p}\le\phi<\pi \\ 0, & -\pi\le\phi\le-\frac{x\pi}{p} \end{Bmatrix}; \tag{1}$$

$$W(\phi)=\begin{Bmatrix} 2\pi p\left[0.42+0.5\cos\left(\frac{p\phi}{x}\right)+0.08\cos\left(2\frac{p\phi}{x}\right)\right], & |\phi|<\frac{x\pi}{p} \\ 0, & \frac{x\pi}{p}\le\phi<\pi \\ 0, & -\pi\le\phi\le-\frac{x\pi}{p} \end{Bmatrix}; \tag{2}$$

$$W(\phi)=\begin{Bmatrix} \exp\left(-\alpha_a\left(\frac{p\phi}{x\pi}\right)^2\right), & |\phi|<\frac{x\pi}{p} \\ 0, & \frac{x\pi}{p}\le\phi<\pi \\ 0, & -\pi\le\phi\le-\frac{x\pi}{p} \end{Bmatrix}; \tag{3}$$

$$W(\phi)=\begin{Bmatrix} \pi p\left(1+\cos\left(\frac{p\phi}{x}\right)\right), & |\phi|<\frac{x\pi}{p} \\ 0, & \frac{x\pi}{p}\le\phi<\pi \\ 0, & -\pi\le\phi\le-\frac{x\pi}{p} \end{Bmatrix}; \tag{4}$$

$$W(\phi)=\begin{Bmatrix} 2\pi p\left[0.54+0.46\cos\left(\frac{p\phi}{x}\right)\right], & |\phi|<\frac{x\pi}{p} \\ 0, & \frac{x\pi}{p}\le\phi<\pi \\ 0, & -\pi\le\phi\le-\frac{x\pi}{p} \end{Bmatrix}; \text{ and} \tag{5}$$

-continued $$W(\phi)=\begin{cases}\dfrac{I_0\left(\omega_a\sqrt{1-\left(\dfrac{p\phi}{x\pi}\right)^2}\right)}{I_0(\omega_a)}, & |\phi|<\dfrac{x\pi}{p}\\ 0, & \dfrac{x\pi}{p}\le\phi<\pi\\ 0, & -\pi\le\phi\le-\dfrac{x\pi}{p}\end{cases}; \quad (6)$$

wherein W(ϕ) represents the window function, p represents the number of the azimuthal positions for which convolved logging sensor data is determined, ϕ represents the borehole azimuth, x, $\omega_a$ and $\alpha_a$ represent factors controlling an azimuthal breadth of the window function, and $I_0$ represents a zero order modified Bessel function of the first kind.

16. The method of claim 5, further comprising:

(f) processing the convolved logging sensor data determined in (e) to determine at least one Fourier coefficient of the azimuthal dependence of the parameter.

17. The method of claim 16, further comprising:

(g) processing the at least one Fourier coefficient of the azimuthal dependence of the parameter determined in (f) to estimate a value of the parameter at an arbitrary azimuth.

18. The method of claim 5, further comprising:

(f) repositioning the tool in the borehole and repeating (b), (c), (d), and (e); and (g) assigning a first borehole depth value to the convolved sensor data determined in (e) and a second borehole depth value to the convolved sensor data determined in (f).

19. The method of claim 5, wherein:

(b) further comprises causing the at least one logging sensor to acquire a plurality of logging sensor measurements at a corresponding plurality of times during each of predetermined first and second time periods;

(c) further comprises causing the at least one standoff sensor and the azimuth sensor to acquire a corresponding plurality of standoff measurements and tool azimuth measurements at the plurality of times in each of the first and second time periods; and (d) further comprises processing the standoff measurements and the azimuth measurements to determine borehole azimuths at selected ones of the plurality of times in the first and second time periods.

20. The method of claim 19, further comprising:

(f) assigning corresponding first and second borehole depth values to the convolved logging sensor data determined in (e) using the logging sensor data acquired during the first and second time periods.

21. The method of claim 5, wherein a plurality of azimuthal positions in (e) are substantially evenly distributed about a circular horizon.

22. The method of claim 5, wherein (d) further comprises:

(i) processing the standoff measurement and the corresponding tool azimuth to determine a standoff vector; and (ii) processing a sum of a lateral displacement vector between borehole and tool coordinate systems and the standoff vector to determine the borehole azimuths.

23. The method of claim 5, wherein (d) further comprises:

(i) processing the standoff measurement and the corresponding tool azimuth to determine a standoff vector; and (ii) processing a sum of a lateral displacement vector between borehole and tool coordinates systems, the standoff vector, and a formation penetration vector to determine the borehole azimuths.

24. The method of claim 5, wherein (d) further comprises processing a system of equations to determine a lateral displacement vector between the borehole and tool coordinate systems, the system of equations including variables representative of (i) the lateral displacement vector, (ii) the standoff measurements, and (iii) the corresponding tool azimuth.

25. The method of claim 24, wherein the system of equations in (d) further comprises at least one variable representative of (iv) a known borehole parameter vector.

26. The method of claim 24, wherein (d) further comprises processing the system of equations to determine the borehole azimuth, the system of equations further comprising variables representative of (iv) the borehole azimuth.

27. The method of claim 5, wherein:

(d) further comprises processing a system of equations to determine the borehole azimuths corresponding to each standoff measurement, a lateral displacement vector between the borehole and tool coordinate systems, and a borehole parameter vector, the system of equations including variables representative of (i) the lateral displacement vector, (ii) the standoff measurements, (iii) the tool azimuths, (iv) the borehole parameter vector, and (v) the borehole azimuths.

28. A system for estimating an azimuthal dependence of a parameter of a borehole using logging sensor measurements acquired as a function of a borehole azimuth of said logging sensors, the system comprising:

a downhole tool including at least one longing sensor, at least one standoff sensor, and at least one azimuth sensor, the downhole tool operable to be coupled to a drill string and rotated in a borehole;

the downhole tool further including a controller, the controller configured to:

(A) cause the at least one logging sensor to acquire a plurality of logging sensor measurements at a corresponding plurality of times;

(B) cause the at least one standoff sensor and the azimuth sensor to acquire a corresponding plurality of standoff measurements and tool azimuth measurements at the plurality of times;

(C) process the standoff measurements and the azimuth measurements to determine borehole azimuth at selected ones of the plurality of times; and (D) process a convolution of the logging sensor measurements acquired in (A) and the corresponding borehole azimuths determined in (C) at selected ones of the plurality of times with a window function to determine convolved logging sensor data for at least one azimuthal position about the borehole.

* * * * *